US007828613B2

(12) United States Patent
Chen

(10) Patent No.: US 7,828,613 B2
(45) Date of Patent: Nov. 9, 2010

(54) CABLE TERMINAL CONNECTOR

(75) Inventor: Ting-Chu Chen, Shanbi Tsuen (TW)

(73) Assignee: Ching-Fu Chen, Taoyuan County (TW)

( * ) Notice: Subject to any disclaimer, the term of this patent is extended or adjusted under 35 U.S.C. 154(b) by 0 days.

(21) Appl. No.: 12/462,672

(22) Filed: Aug. 10, 2009

(65) Prior Publication Data

US 2010/0159756 A1 Jun. 24, 2010

(30) Foreign Application Priority Data

Dec. 19, 2008 (TW) ..... 97149868 A

(51) Int. Cl.
*H01R 11/11* (2006.01)

(52) U.S. Cl. ..... 439/883

(58) Field of Classification Search ..... 439/883, 439/857, 860

See application file for complete search history.

(56) References Cited

U.S. PATENT DOCUMENTS 5,108,320 A * 4/1992 Kimber ..... 439/883

* cited by examiner

*Primary Examiner*—Phuong K Dinh
(74) *Attorney, Agent, or Firm*—Bacon & Thomas, PLLC

(57) ABSTRACT

This invention is a cable terminal connector, primarily comprising of a U-shaped contact body at the front end of the connector, with a compressible slot located between its upper and lower faces, forming upper and lower resilient clamping faces above and below the compressible slot. When the cable terminal connector's U-shaped contact body is held in place by the cap, the resilient clamping faces on the U-shaped contact body spring back to hold the cap in place, preventing it loosening and increasing the stability of conduction, thereby making it a more effective cable terminal connector.

1 Claim, 7 Drawing Sheets

CABLE TERMINAL CONNECTOR

BACKGROUND OF THE INVENTION

1. Field of the Invention

This invention is a cable terminal connector, namely one that is easier to screw and has improved contact point stability than existing ones.

2. Description of the Prior Art

Given that typical connector posts often are tightened by turning with the fingers for convenience (especially connections between AV equipment), and have no way of keeping the cable terminal connector locked tight, a slight moving or shaking of the wire can easily cause the connection between the terminal and the connector post to loosen, increasing impedance of the connection and causing poor conduction, as well as possibly producing sparks that can cause fire. With reference to the fork plug in FIG. 1, the front end of the main body of the plug (A) is fork-shaped connector (A1). The outer body of the plug (A) is surrounded by an insulating body (B) to protect the point where it connects with electrical leads.

The commonly used cable terminal connector described above had to be designed in this fashion to accommodate contact points and outlets, but it presents an almost insurmountable problem for users: the connector (A1) at the front of the plug (A) and the threading of the cap are both metal making it difficult to tighten the cap using the fingers, leading to frequent loosening and short-circuits.

The cable terminal connector (E) as shown in FIG. 2, was therefore developed. It comprised mainly of a base plate (E1) and a cover plate (E2) fitted on the front end of the cable terminal connector (E). The base plate (E1) and cover plate (E2) are made of two pieces of different materials placed on top of one another. At the front ends of the base plate (E1) and cover plate (E2), resilient washer (E3) are inserted to provide an elastic effect when the cable terminal connector (E) is screwed in. Another cable terminal connector (F) has also been developed as shown in FIG. 3. This cable terminal connector (F) comprises mainly of a contact fork (F1) at its front end which is attached to a fork shaft (F2), with the contact fork (F1) including a base plate (F3), elastomer material (F4), with a cover plate (F5) over the elastomer material (F4). When the cable terminal connector (F) is screwed into place, the elastomer material (F4) provides better cushioning from vibration.

Although two of the cable terminal connectors (E), (F) described above can provide elasticity when screwed in place and cushion mechanical vibrations, the problem of coming unscrewed from the terminal can still occur when they are pulled by inappropriate external force so their use still has disadvantages. Furthermore, current environmental protection requirements mean the cable terminal connectors (E), (F) will be melted down and recycled; however, this is complicated by the fact that the connectors contain several different kinds of materials and elastomers, a situation that currently presents considerable problems for recycling.

SUMMARY OF THE INVENTION

The main objective of this invention is to provide a cable terminal connector to make wiring work more convenient, protect against loosening and stabilize contact points to prevent short-circuits.

It is mainly comprised by a compressible slot between the upper and lower faces of the U-shaped contact body at the front of the cable terminal connector, and upper and lower elastic clamping faces above and below the compressible slot.

BRIEF DESCRIPTION OF DRAWINGS

This invention is better understood by referring to the accompanying drawings, wherein.

DETAILED DESCRIPTION OF THE PREFERRED EMBODIMENT

Figure 1:
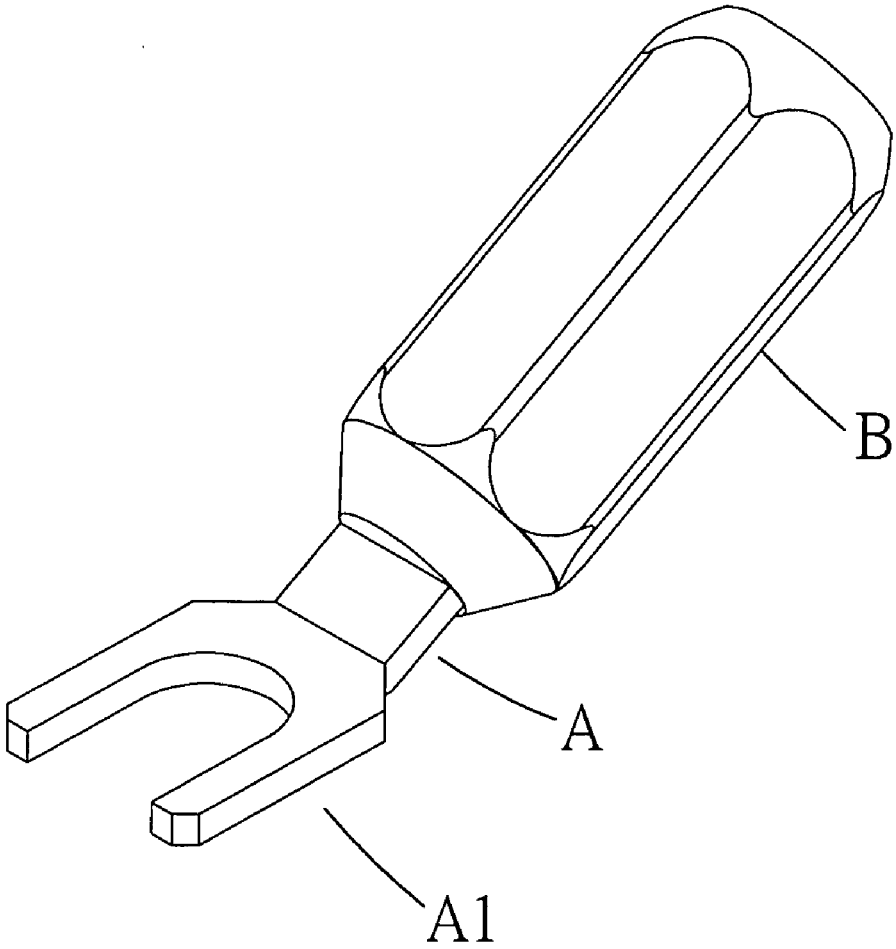
FIG.1 (PRIOR ART)
FIG. 1 is a perspective view of a conventional cable terminal connector.
Figure 2:
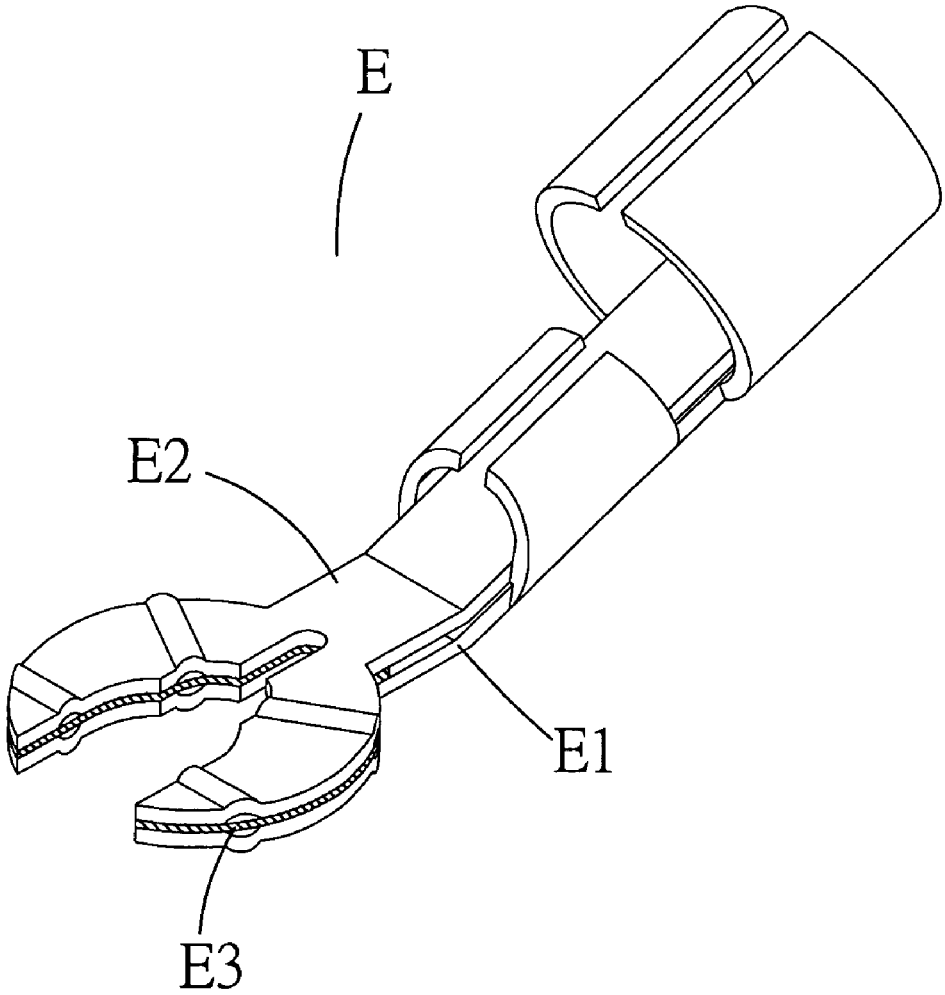
FIG.2 (PRIOR ART)
FIG. 2 is a perspective view of a conventional cable terminal connector.
Figure 3:
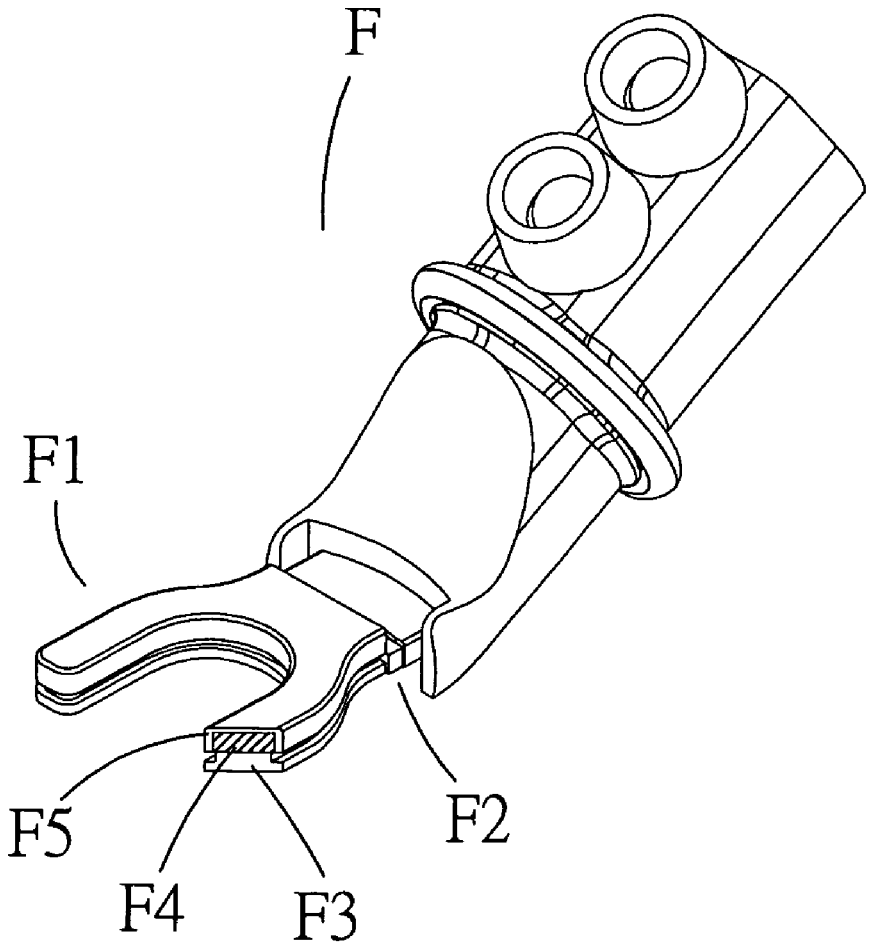
FIG.3 (PRIOR ART)
FIG. 3 is a perspective view of a conventional cable terminal connector.
Figure 4:
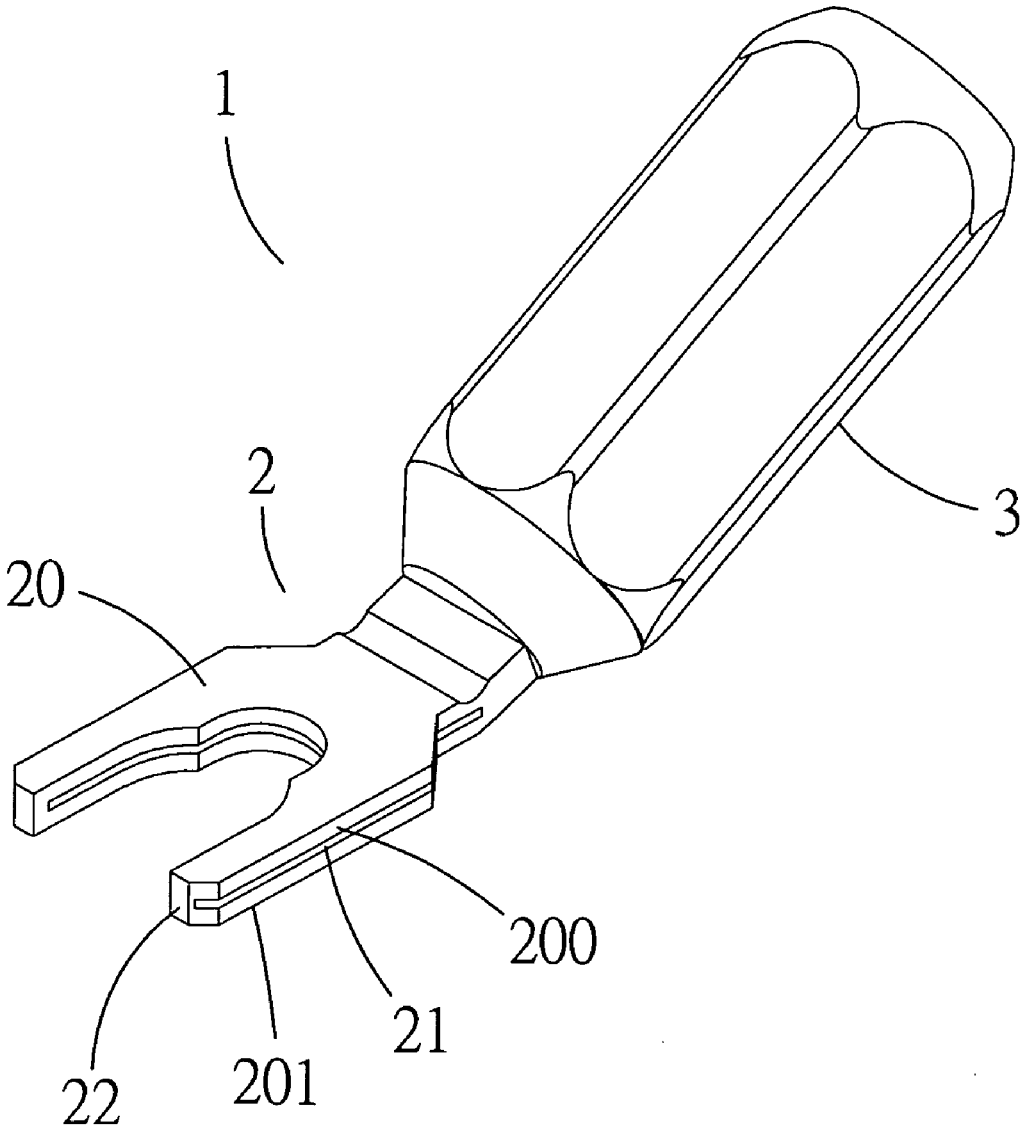
FIG. 4 is a perspective view of the cable terminal connector in the present invention.

As shown in FIG. 4, a preferred embodiment of the cable terminal connector includes a cable terminal connector 1, the front end is equipped with a single-material U-shaped contact body 2, while the rear end is fitted with an insulating body 3.

The two prongs 20 of U-shaped contact body 2 have a compressible slot 21 which contains upper and lower elastic clamping faces 200, 201, making the thickness of the front ends 22 of the two prongs 20 of U-shaped contact body 2 greater than the thickness of the upper and lower elastic clamping faces 200, 201 of the compressible slot 21.

Figure 5:
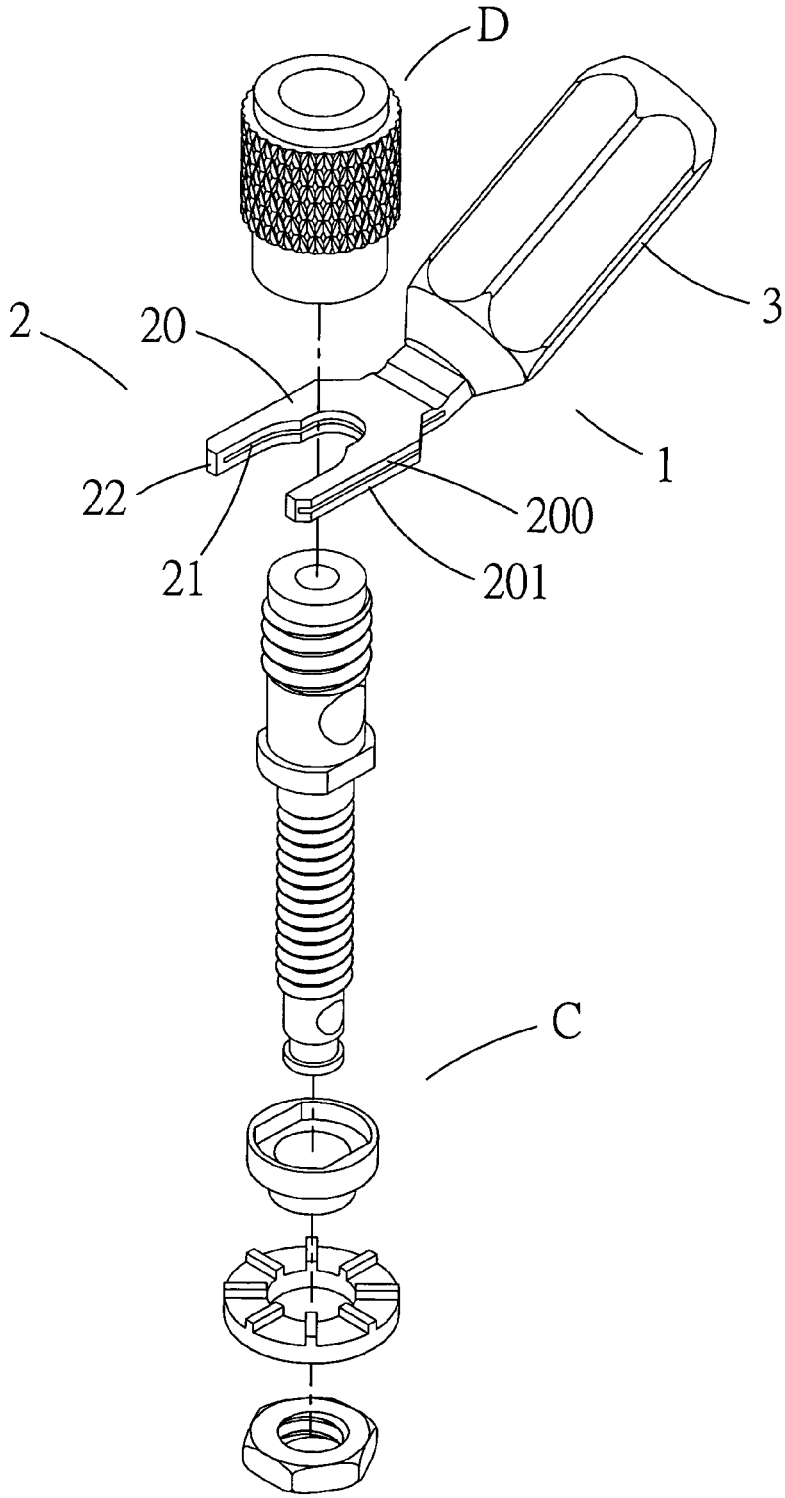
FIG. 5 is an exploded view of the cable terminal connector in the present invention.
Figure 6:
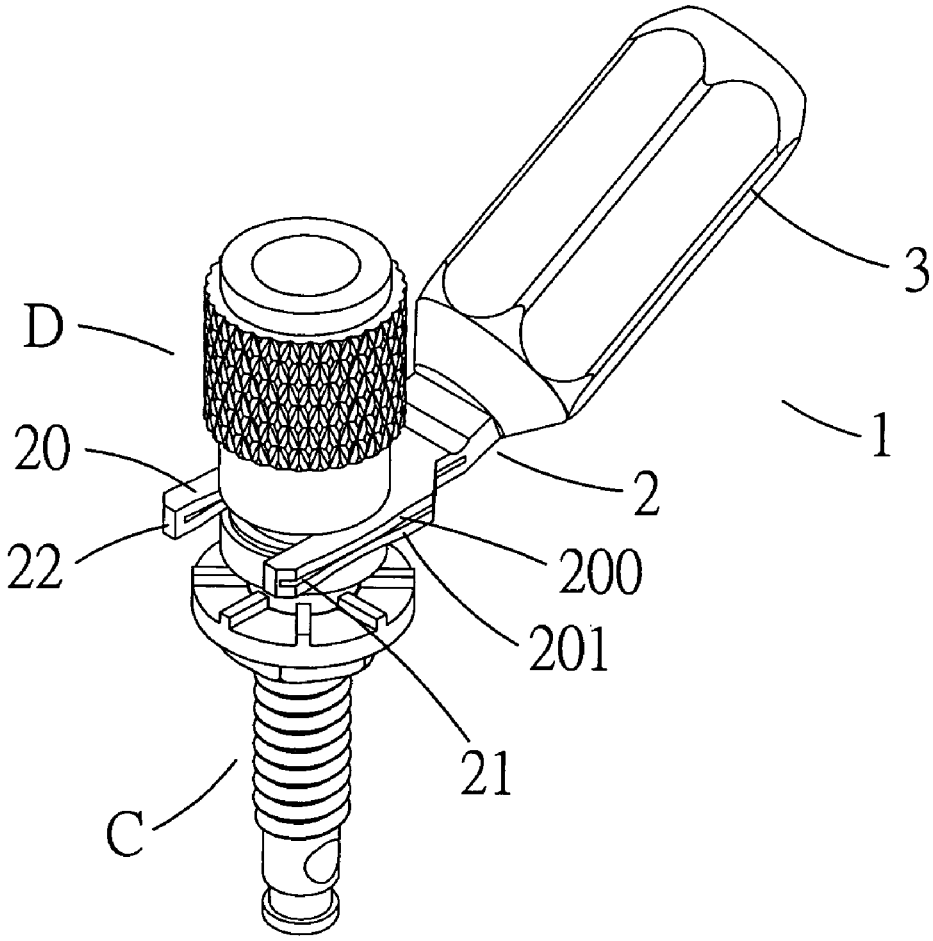
FIG. 6 is a perspective view of the cable terminal connector of using condition of the present invention.
Figure 7:
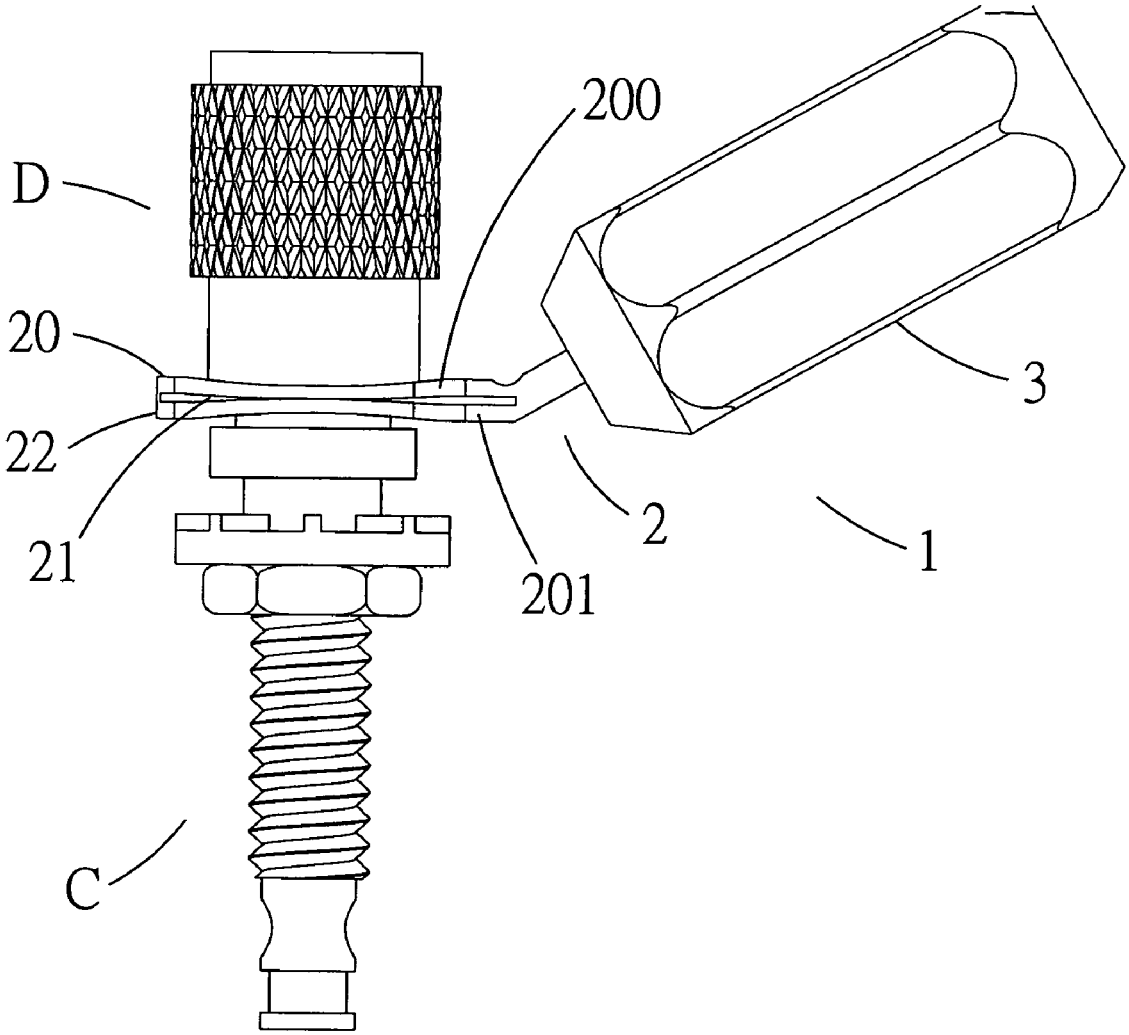
FIG. 7 is a side view of FIG. 6.

When used (as shown in FIGS. 5 to 7), the cable terminal connector 1 is placed on a connector post (C) and the cap (D) is screwed in place and the cap (D) screws into the threads of the connector post (C), causing it to press tightly on the U-shaped contact body 2 of cable terminal connector 1. When the cap (D) is screwed on and presses down on the compressible slot 21 of U-shaped contact body 2, the prongs 20 of the U-shaped contact body 2 are compressed into a concave shape, as shown in FIGS. 6 and 7. At this time, the cap (D) is pressing tightly down on the U-shaped contact body 2, which is firmly into the connector post (C). Because the cap (D) is subject to an elastic spring-back effect simultaneously produced by connector post (C) and compressible slot 21 of the U-shaped contact body 2, therefore the cap (D), U-shaped contact body 2 and contactor post (C) are pressed tightly together. Furthermore, the cap (D) presses down on the upper and lower elastic clamping faces 200, 201 of compressible slot 21 making their thickness far less than that of the front ends 22 of U-shaped contact body 2, so that when it is subjected to inappropriate external force and pulling it will not break loose from the grip of cap (D).

The above explanation shows that this invention has the following advantages:

1. The compressible slot 21 design allows the cable terminal connector 1 to be more tightly fixed to the connector post, thereby allowing for better conduction results.

2. The elasticity formed by the compressible slot 21 of cable terminal connector 1 can effectively absorb external vibrations or movement of the electrical wires, so that when the cap (D) is screwed on to the compressible slot 21 vibration will not cause the connection to come loose.

3. The connection between the cable terminal connector 1 and the connector post (C) is elastic therefore avoiding sparking due to poor connection.

4. The thickness of the front ends 22 of the U-shaped contact body 2 of cable terminal connector 1 is far greater than the thickness of the upper and lower elastic clamping faces 200, 201 when pressed together; as a result, even if the U-shaped contact body 2 of cable terminal connector 1 is subject to external pulling, it will not slip free from the grip of the cap (D).

5. The U-shaped contact body 2 of cable terminal connector 1 is made of a single material, making it very easy to recycle.

6. This invention of a cable terminal connector 1 is a single part without secondary connections, and therefore will not add impedance to the connection.

While the preferred embodiment of the invention has been described above, it will be recognized and understood that various modifications may be made therein and the appended claims are intended to cover all such modifications that may fall within the spirit and scope of the invention.

What is claimed is:

1. A cable terminal connector, comprising:

a connector element having a front formed as a single material U-shaped contact body and a rear, the U-shaped contact body having two prongs each having a solid front end and a compressible slot extending rearward from the solid front end and defining an upper and a lower clamping face separated by the compressible slot, whereby in a region of the compressible slots the upper and lower clamping faces are compressible together to a thickness less than a thickness of the front ends; and an insulating body fitted to the rear end of the connector element.

* * * * *